US011597109B2

(12) United States Patent
Skodras et al.

(10) Patent No.: US 11,597,109 B2
(45) Date of Patent: Mar. 7, 2023

(54) ADJUSTABLE SHAVING BLADE ASSEMBLY AND RAZOR

(71) Applicant: BIC VIOLEX S.A., Anoixi (GR)

(72) Inventors: Evaggelos Skodras, Marousi-Athens (GR); Yiannis Psomiadis, Piraeus (GR)

(73) Assignee: BIC Violex Single Member S.A., Anoixi (GR)

( * ) Notice: Subject to any disclaimer, the term of this patent is extended or adjusted under 35 U.S.C. 154(b) by 0 days.

(21) Appl. No.: 16/962,063

(22) PCT Filed: Dec. 20, 2018

(86) PCT No.: PCT/EP2018/086372
§ 371 (c)(1),
(2) Date: Jul. 14, 2020

(87) PCT Pub. No.: WO2019/141488
PCT Pub. Date: Jul. 25, 2019

(65) Prior Publication Data

US 2020/0346357 A1 Nov. 5, 2020

(30) Foreign Application Priority Data

Jan. 17, 2018 (EP) ..... 18152166

(51) Int. Cl.
*B26B 21/22* (2006.01)
*B26B 21/40* (2006.01)

(52) U.S. Cl.
CPC ..... *B26B 21/225* (2013.01); *B26B 21/4062* (2013.01)

(58) Field of Classification Search
CPC ..... B26B 21/225; B26B 21/4062; B26B 21/4031; B26B 21/22; B26B 21/12; B26B 21/56
See application file for complete search history.

(56) References Cited

U.S. PATENT DOCUMENTS 2,252,628 A * 8/1941 Grachan ..... B26B 21/12 30/30
2,711,014 A * 6/1955 Spanel ..... B26B 21/12 30/31

(Continued)

FOREIGN PATENT DOCUMENTS

CN 102126223 A 7/2011
DE 10 2004 020 650 A1 11/2005

(Continued)

OTHER PUBLICATIONS

International Search Report and Written Opinion issued in International Application PCT/EP2018/086372, dated Feb. 1, 2019 (13 pages).

(Continued)

*Primary Examiner* — Evan H MacFarlane
*Assistant Examiner* — Liang Dong
(74) *Attorney, Agent, or Firm* — Bookoff McAndrews, PLLC

(57) ABSTRACT

A shaving blade assembly (10) comprises a plurality of parallel blades (20) including a first blade (20) and a first rack-and-pinion mechanism (50) with a rack (51) coupled to the first blade (20) to actuate the first blade (20) in a first direction (M) orthogonal to a cutting edge (21) of the first blade (20). The shaving blade assembly (10) may be part of a razor (100,100') and the position of the first blade (20) may be adjusted in the first direction (M) using a method comprising a step of actuating the first blade (20) in the first direction (M) through the rack-and-pinion mechanism (50).

20 Claims, 4 Drawing Sheets

(56) References Cited

U.S. PATENT DOCUMENTS

| | | | | |
|---|---|---|---|---|
| 3,667,121 | A | 6/1972 | Dorion, Jr. et al. | |
| 3,855,695 | A | 12/1974 | Spanel | |
| 3,955,277 | A * | 5/1976 | Pomfret | B26B 21/22 30/47 |
| 4,345,374 | A | 8/1982 | Jacobson | |
| 5,253,420 | A * | 10/1993 | Althaus | B26B 21/227 30/47 |
| 5,313,706 | A | 5/1994 | Motta et al. | |
| 6,070,327 | A | 6/2000 | Taso | |
| 2016/0346944 | A1 | 12/2016 | Sadrialaei | |
| 2018/0311845 | A1* | 11/2018 | Moustakas | B26B 21/4012 |

FOREIGN PATENT DOCUMENTS

| | | | | |
|---|---|---|---|---|
| DE | 102010022606 | A1 * | 12/2011 | B26B 21/227 |
| GB | 656371 | A | 8/1951 | |
| WO | 93/01917 | A1 | 2/1993 | |

OTHER PUBLICATIONS

Office Action issued in Chinese Application 2018800778160 dated Jul. 21, 2021 (7 pages).
Second Office Action issued in CN201880077816 dated Mar. 15, 2022 (7 pages).

* cited by examiner

ADJUSTABLE SHAVING BLADE ASSEMBLY AND RAZOR

CROSS REFERENCE TO RELATED APPLICATIONS

This application is a National Stage Application of International Application No. PCT/EP2018/086372, filed on Dec. 20, 2018, now published as WO2019/141488 and which claims priority to European Patent Application EP18152166.7, filed on Jan. 17, 2018.

TECHNICAL FIELD

The disclosure relates to shaving blade assemblies and to razors comprising such shaving blade assemblies for shaving, for instance, facial, head and/or body hair. The shaving blade assembly may be adapted to attach to a razor handle and may further be interchangeable, in particular when a blade or blades of the shaving blade assembly has been blunted, or it may be integrally formed with the razor handle, thus forming a disposable razor to be disposed with after the blade or blades of the shaving blade assembly has been blunted.

BACKGROUND

According to the personal preference, hair growth and/or anatomy of razor users, they may desire to shave more or less boldly. By "bold", we must understand shaving wherein the cutting edge of each shaving blade is pressed with a stronger pressure and/or angle of attack against the user's skin, thus cutting the protruding hairs closer to the skin, but at a higher risk of irritating the skin itself. The same user may even prefer or require more aggressive shaving of certain areas, and more sensitive, that is, less aggressive, shaving of others.

Shaving heads or blade units comprising a plurality of blades with adjustable exposure mechanisms are already commonly known in the art. For example, U.S. Patent Application Publication US 2016/0346944 A1 disclosed shaving blade assemblies with blades that can be pivoted around axes parallel to their cutting edges. Similar pivoting blade arrangements were disclosed in U.S. Pat. Nos. 5,313,706 and 4,345,374. Such pivoting blade arrangements present however some drawbacks: firstly, the pivoting blades cannot be individually sprung, and secondly, pivoting the blades towards the shaving plane to obtain more sensitive shaving simultaneously narrows the space between adjacent parallel blades, which decreases the shaving efficacy, while rendering cleaning more difficult.

U.S. Pat. No. 3,955,277, on the other hand, disclosed a shaving assembly with two blades arranged to slide, perpendicularly to their respective cutting edges, with respect to a blade guard, so as to adjust their exposure, and U.S. Pat. No. 3,667,121 disclosed a razor with a movable blade cap for adjusting the blade exposure. These mechanisms, however, also appear to be incompatible with individually sprung blades.

In another example, German Patent Application Publication DE 10 2004 020 650 A1 disclosed a shaving blade assembly and razor with a plurality of parallel blades and at least one of a blade pivoting mechanism and a blade sliding mechanism. The blade sliding mechanism in this shaving blade assembly and razor is a cam or a screw mechanism for sliding the plurality of blades in a first direction orthogonal to their cutting edges, so as to increase or decrease the blade exposure out of a blade housing, and thus achieve a more or less bold shave. Even without the blade pivoting mechanism, however, these proposed blade sliding mechanisms still have the drawback of a relatively low adjustment precision.

SUMMARY

An object of the disclosure is therefore that of providing a shaving blade assembly with blade exposure that can be adjusted with particularly high precision to obtain a more aggressive or more sensitive shave, while still allowing the blade or blades contained therein to be individually sprung.

According to aspects of the present disclosure, a shaving blade assembly may comprise a first blade and a first rack-and-pinion mechanism with a rack directly or indirectly coupled to the first blade to actuate the first blade in a first direction orthogonal to a cutting edge of the first blade. Such a rack-and-pinion mechanism can thus adjust the blade exposure, to obtain a more aggressive or sensitive shave, by moving the blade with great precision in the first direction.

Accordingly, in at least one aspect, the shaving blade assembly may be resiliently coupled to the rack. The first blade can thus be sprung, and even individually sprung, for a closer and yet sensitive shave.

Accordingly, in at least one aspect, the shaving blade assembly may further comprise a detent mechanism for releasably holding the first blade in at least one position along the first direction. More specifically, the shaving blade assembly may further comprise a housing, and the detent mechanism be arranged between the housing and the rack or a pinion of the first rack-and-pinion mechanism. In particular, in the latter case, the pinion may be coupled in rotation with a rotary shaft and the detent mechanism be arranged between the housing and the rotary shaft. With such a detent mechanism, it is thus possible to stop and hold the first blade in at least one, and possibly a plurality of well-defined positions, each corresponding to a degree of shaving aggressiveness.

Accordingly, in at least one, alternative aspect, however, the shaving blade assembly may instead further comprise a brake mechanism for frictionally holding the first blade in at least one position along the first direction. Like the detent mechanism, this brake mechanism may be arranged between a housing and a rack or a pinion of the first rack-and-pinion mechanism, and in particular between the housing and a rotary shaft coupled in rotation with the pinion. This brake mechanism offers a possibility of gradual adjustment over a range of minutely different positions.

Accordingly, in at least one aspect, the cutting edge of the first blade may extend from a first end of the first blade to a second end of the first blade, the rack of the first rack-and-pinion mechanism being coupled to the first end of the first blade, and the shaving blade assembly may further comprise a second rack-and-pinion mechanism with a rack coupled to the second end of the first blade. In this case, a pinion of the first rack-and-pinion mechanism and a pinion of the second rack-and-pinion mechanism may be coupled in rotation by a rotary shaft. Such twin, eventually coupled rack-and-pinion mechanisms at the two ends of the first blade may ensure an equal advancement or retreat of the first blade along the first direction over the whole length of the first blade between its two ends.

Accordingly, in at least one aspect, the shaving blade assembly may comprise a plurality of parallel blades including the first blade. In this case, the first direction may be inclined with respect to a plane defined by cutting edges of the plurality of blades. Including a plurality of blades in the shaving blade assembly allows for a cleaner, faster shave, whereas inclining the first direction, which is the direction of actuation by the rack-and-pinion mechanism, with respect to the plane of the cutting edges of the plurality of blades provides a finer, more accurate adjustment of the position of the plurality of blades perpendicularly to this plane. Alternatively, however, the first direction may instead be perpendicular to this plane.

Accordingly, in at least one aspect, the shaving blade assembly may further comprise a releasable connector for connecting the shaving blade assembly to a razor handle, thus forming an exchangeable blade cartridge of a razor comprising this shaving blade assembly and the razor handle when connected to the releasable connector of the shaving blade assembly.

Accordingly, in at least one, alternative aspect of the present disclosure, however, a disposable razor may comprise a shaving blade assembly as previously described and an integrally formed razor handle.

Finally, the present disclosure also relates to a method for adjusting position of a first blade of a shaving blade assembly in a first direction orthogonal to a cutting edge of the first blade, which may comprise a step of actuating the first blade in the first direction through a rack-and-pinion mechanism with a rack coupled to the first blade.

The above summary of some aspects of the present disclosure is not intended to describe each disclosed embodiment or every implementation. In particular, selected features of any illustrative embodiment within this specification may be incorporated into an additional embodiment unless clearly stated to the contrary.

BRIEF DESCRIPTION OF THE DRAWINGS

The disclosure may be more completely understood in consideration of the following detailed description of various embodiments in connection with the accompanying drawings, in which.

Figure 1:
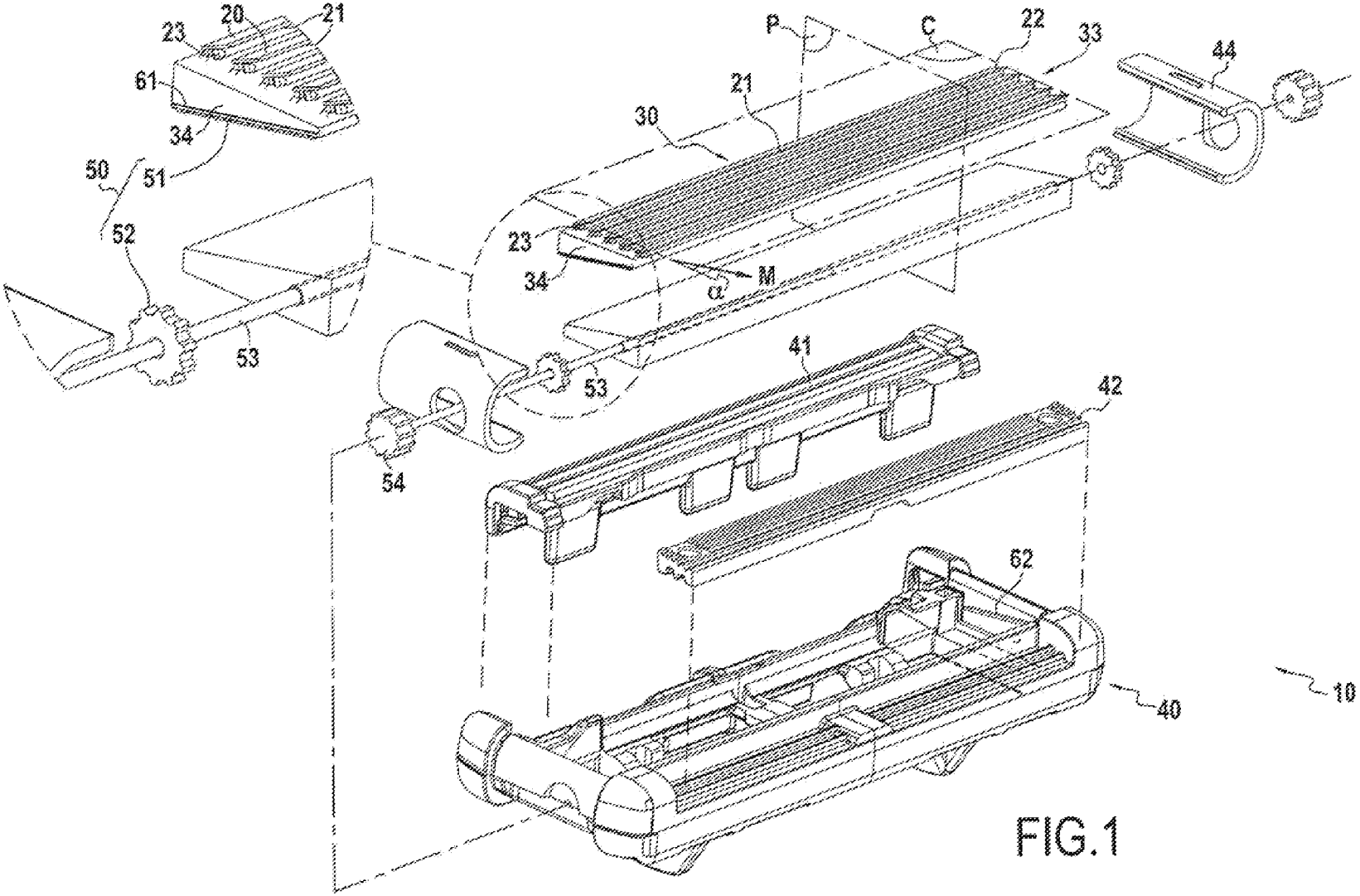
FIG. 1 is an exploded perspective view of a shaving blade assembly according to a first embodiment

While the disclosure is amenable to various modifications and alternative forms, specifics thereof have been shown by way of example in the drawings and will be described in detail. It should be understood, however, that the intention is not to limit aspects to the particular embodiments described. On the contrary, the intention is to cover all modifications, equivalents, and alternatives falling within the scope of a fair reading of appended claims.

DETAILED DESCRIPTION

For the following defined terms, these definitions shall be applied, unless a different definition is given in the claims or elsewhere in this specification.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the invention. The illustrative embodiments depicted are intended only as exemplary. Selected features of any illustrative embodiment may be incorporated into an additional embodiment unless clearly stated to the contrary.

FIG. 1 illustrates schematically a shaving blade assembly 10 comprising a plurality of parallel blades 20, each one of them with an exposed cutting edge 21 for shaving. The blades 20 are offset from each other perpendicularly to these cutting edges 21, which define together a plane C. Each blade 20 extends longitudinally along its cutting edge 21 from a first end 22 to a second end 23 of the blade 20. As illustrated, the blades 20 may be inclined with respect to the plane C defined by their cutting edges 21. Although in the illustrated example embodiment the shaving blade assembly 10 comprises a plurality of parallel blades 20, any number of blades 20, including a single one, may be considered according to the circumstances.

Figure 2:
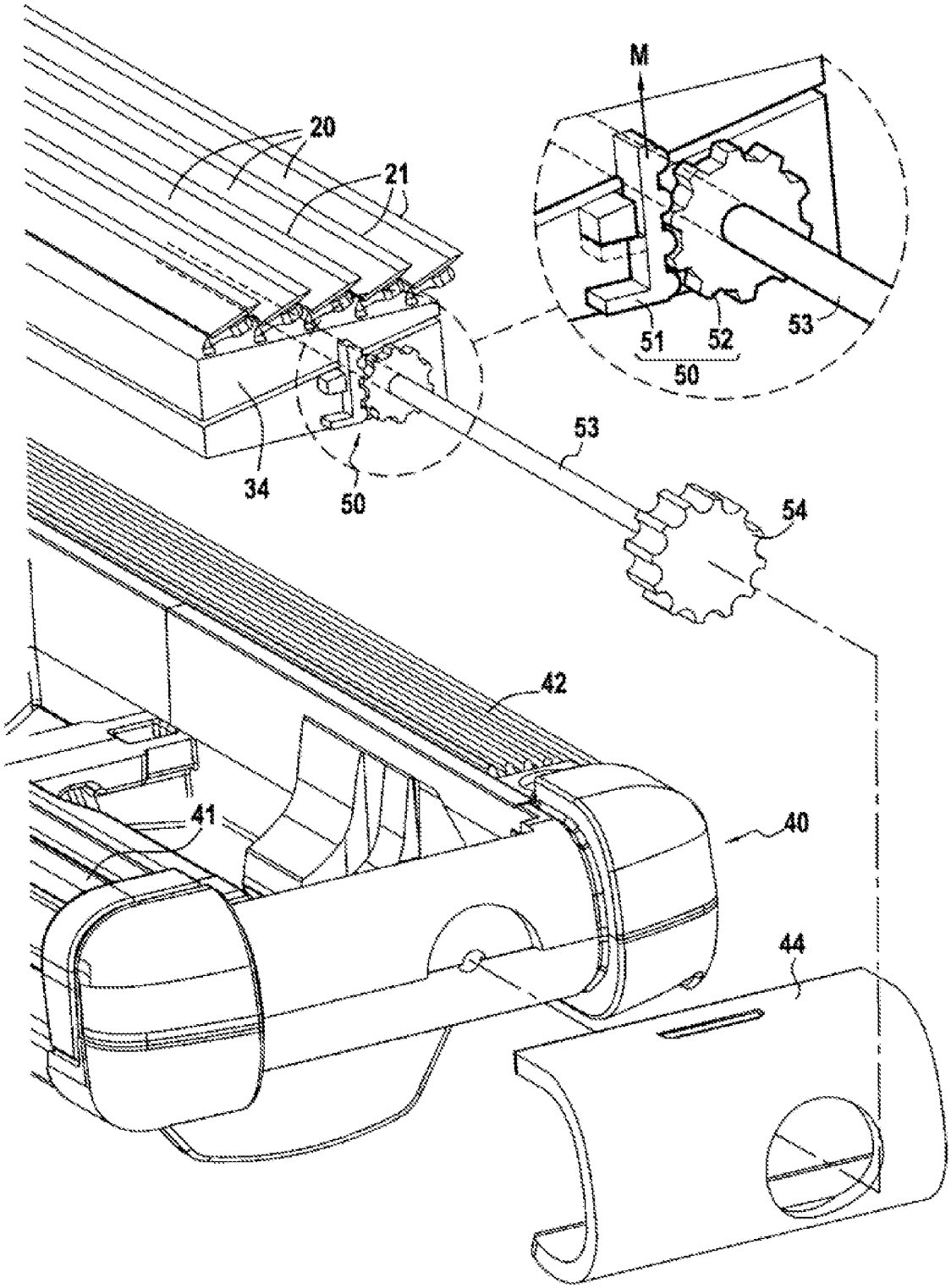
FIG. 2 is a partial, exploded perspective view of a shaving blade assembly according to a second embodiment

As in the illustrated shaving blade assembly 10, a blade carrier 30 may hold the blades 20 together. The blades 20 may be fixedly or resiliently attached to the blade carrier 30. In particular, each blade 20 may be individually sprung within the blade carrier 30. Furthermore, as also illustrated in FIG. 1 this blade carrier 30 may be movably held within a housing 40. More specifically, the shaving blade assembly 10 may comprise at least one rack-and-pinion mechanism 50 for actuating movement of the blade carrier 30, and thus of each blade 20, with respect to the housing 40 in a first direction M. This first direction M may be orthogonal to the cutting edges 21 of the blades 20, which means any direction in a plane P perpendicular to the cutting edges 21. The first direction M may thus be, as shown in FIG. 1, inclined with respect to the plane C of the cutting edges 21, but it may instead be perpendicular to the plane C, as in the alternative embodiment illustrated in FIG. 2. As shown on FIG. 1, a rack-and-pinion mechanism 50 may be arranged at one or both longitudinal ends 33, 34 of the blade carrier 30, adjacent to the first and/or second ends 22, 23 of the blades 20.

More specifically, each rack-and-pinion mechanism 50 may comprise a rack 51, oriented in the first direction M, and in engagement with a pinion 52. A guide 60 oriented in the first direction M may guide the movement of the blade carrier 30, and thus each blade 20, with respect to the housing 40, in the first direction M. As in the embodiment illustrated in FIGS. 1 and 3, this guide 60 may be formed by a rear surface 61 of the rack 51 of each rack-and-pinion mechanism 50 and an opposite guiding surface 62 in the housing 40 engaging the rear surface 61. However, alternative guiding arrangements may also be considered to guide the movement of a blade 20 actuated through the rack-and-pinion mechanism 50. For instance, guiding surfaces oriented in the first direction M may be formed elsewhere on the blade carrier 30 and/or housing 40. If the blades 20 are individually sprung within the blade carrier 30, each blade 20 is thus resiliently coupled, through the blade carrier 30, to each rack 51. Alternatively, however, the blades 20 may be fixed with respect to the blade carrier 30.

As illustrated in FIG. 1, in each rack-and-pinion mechanism 50 a rotary shaft 53 may rotationally couple the pinion 52 to a dial wheel 54, at least partially exposed outside the housing 40, for manually operating the rack-and-pinion mechanism 50 through the dial wheel 54. As also illustrated in FIG. 1, this rotary shaft 53 may also extend between the rack-and-pinion mechanisms 50 at each longitudinal end 33, 34 of the blade carrier 30 so as to couple their respective movements and ensure that the whole blade carrier 30 moves evenly in the first direction M when one or both dial wheels 54 are manually operated. The skilled person can also understand that, although the illustrated embodiment includes a dial wheel 54 for each rack-and-pinion mechanism 50, if the two rack-and-pinion mechanisms 50 are coupled through the rotary shaft 53, a single dial wheel 54 may be used to operate both rack-and-pinion mechanisms 50 simultaneously. Each dial wheel 54 may comprise indices, for instance color-coded and/or numbered indices, to indicate the position of the corresponding rack-and-pinion mechanism 50. When the rack-and-pinion mechanisms 50 are not coupled, these indices may help the user to set both rack-and-pinion mechanisms 50 in the same position.

A front face 43 of the housing 40 may define a shaving plane S. For instance, as shown on FIGS. 1 and 3, the housing 40 may comprise a lubricant strip 41 and/or a guard bar 42 disposed on the front face 43, and the shaving plane S be defined by a line tangent to the lubricant strip 41 and guard bar 42. The lubricant strip 41 and/or finned guard bar 42 may be configured to further improve the shaving feel. The term "exposure" as used herein is intended to mean the distance from each cutting edge 21 of a blade 20 to this shaving plane S, perpendicularly to the shaving plane S. Blade exposure is typically considered positive when the blade edge 21 protrudes out of the housing 40 beyond this shaving plane S and is considered negative when the blade edge 21 is retracted into the housing 40 behind this shaving plane S, at rest position.

The housing 40 may further comprise a blade retainer 44, and in particular a blade retainer 44 at each end of the housing 40 in the direction of the cutting edges 21 of the blades 20. These blade retainers 44 may be configured to contact each blade 20 to retain it within the housing 40. As shown, they may present a C-shaped cross section, and may present some resilience against deformation in the first direction M. If the blade 20 is sprung with respect to the blade carrier 30, each blade retainer may act as a counter-spring so that a relative movement of the blade carrier 30 in the first direction M may load or unload the resilient connection of the blade 20 with the blade carrier 30 when the blade 20 contacts the blade retainer 44, so as to obtain more or less bold shaving.

In order to hold the position of each blade 20 in the first direction M, in a releasable manner, before and/or after its actuation through each rack-and-pinion mechanism 50, the shaving blade assembly 10 may further comprise a detent mechanism 70, including for example a protrusion 71 in a first surface resiliently loaded to engage a corresponding recess 72 in a second surface facing the first surface. If the second surface presents a plurality of such recesses 72, the detent mechanism 70 may be suitable to releasably hold each blade 20 in a plurality of different positions in the first direction. This detent mechanism 70 may be arranged in several different, alternative positions in the shaving blade assembly 10.

Figure 3:
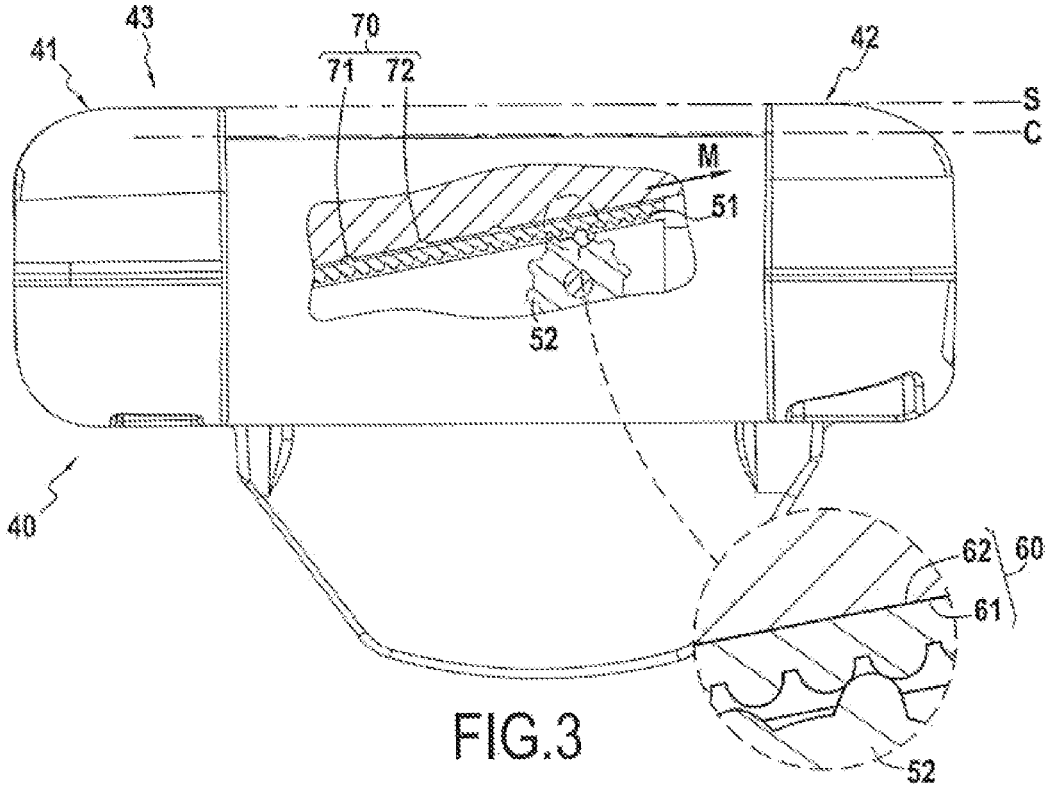
FIG. 3 is a lateral cutaway view of the shaving blade assembly of FIG. 1

According to a first possible arrangement, illustrated by FIG. 3, the detent mechanism 70 may be formed in the guide 60. More specifically, in the illustrated embodiment, the protrusion 71 may be formed on the guiding surface 62 and a plurality of corresponding recesses 72 may be formed along the rear surface 61 of the rack 51, although it can also be envisaged to invert this arrangement. A resilient load may be exerted on the rack 51 by a slight radial deformation of the pinion 52 and/or flexing of the rotary shaft 53, so as to both ensure continuous engagement of the pinion 52 with the rack 51 and of the surfaces 61,62 of the guide 60 against each other, while urging the protrusion 71 into each corresponding recess 72 to resiliently and releasably hold a position of the blade carrier 30, and thus the blades 20, with respect to the housing 40. This arrangement thus ensures precision in actuation, guidance and position-holding of the blade retainer 30 and blades 20 along the first direction M.

Figure 4:
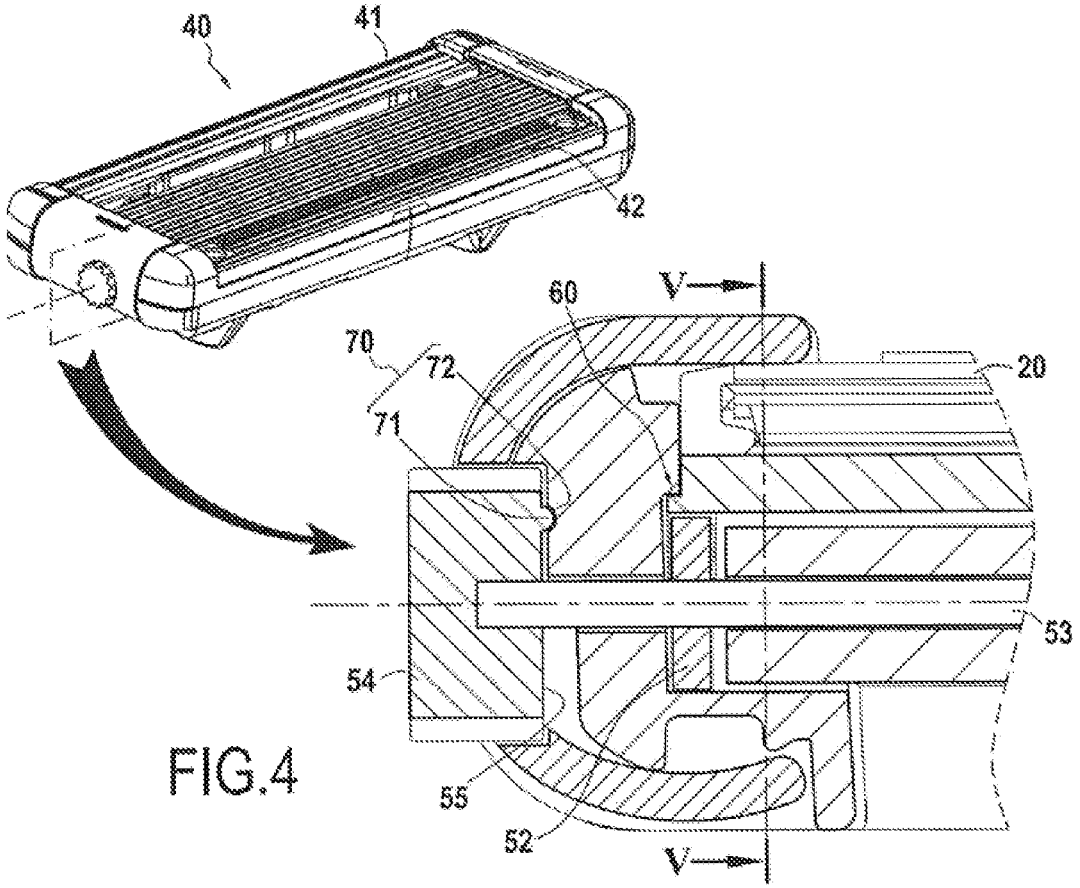
FIG. 4 is a transversal cross section of a shaving blade assembly according to a third embodiment

According to a second, alternative arrangement, illustrated by FIG. 4, the protrusion 71 may be formed on a surface 55 of the dial wheel 54 and a plurality of corresponding recesses 72 may be formed on a surface 41 of the housing 40, opposite to the surface 55 of the dial wheel 54, although this arrangement may also be inverted. In this particular arrangement, the recesses 72 may be aligned along a circular path, as shown, so that the protrusion 71 will travel from one recess 72 to the next adjacent recess 72 as the dial wheel 54 rotates. An axial tension on rotary shaft 53 can provide a resilient load to urge the protrusion 71 into each recess 72 to resiliently and releasably hold a position of the blade carrier 30, and thus the blades 20, with respect to the housing 40.

Figure 5:
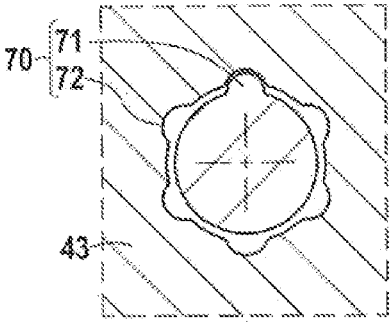
FIG. 5 is a detail view of a shaving blade assembly according to a fourth embodiment

According to yet another alternative arrangement, illustrated by FIG. 5, the protrusion 71 may be formed on an outer surface of the rotary shaft 53 and the corresponding recesses 72 may be formed in an inner periphery of an orifice 45 in the housing 40, bearing the rotary shaft 53 at the axial position where the protrusion 71 is located. As in the previous examples, this arrangement may also be inverted, so that the protrusion 71 is located in the inner periphery of orifice 45 and the recesses 72 on the outer surface of the rotary shaft 53. In either case, a slight press fit of the rotary shaft 53 within the orifice 45 may ensure that the protrusion 71 is resiliently urged into each recess 72.

In each of these embodiments, as a further safety measure, the detent mechanism 70 may be configured so that an external force, on the at least one blade 20, perpendicularly to the shaving plane S, exceeding a threshold $F_{max}$, may release the detent mechanism 70 from the position it holds, and actuate a movement of the at least one blade 20 in the first direction M into the housing 40 at least to the next holding position of the detent mechanism 70. Since the force pressing against the at least one blade 20 perpendicularly to the shaving plane S during shaving typically ranges between 0.1 and 0.7 N, this threshold $F_{max}$ may be 0.7 N.

Alternatively to any such detent mechanism, however, the shaving blade assembly 10 may instead comprise a brake mechanism to frictionally hold the blade carrier 30, and thus each blade 20, with respect to the housing 40, against movement in the first direction M. For this purpose, the brake mechanism may include any frictional means interposed between the blades 20 and the housing 40, including, but not limited to mating textured surfaces. For example, the brake mechanism may be formed in the guide 60, wherein the friction coefficient and pressure between the guiding surface 62 and the rear surface 61 of the rack 51 may be selected to oppose a frictional resistance to movement in the first direction. If the first direction M is inclined with respect to the plane C of the cutting edges 21 of the blades 20, the friction coefficient and the inclination angle α (ALPHA) between the first direction M and the plane C may even be selected to ensure that any pressure perpendicularly to the plane C will lock this brake mechanism.

Figure 6:
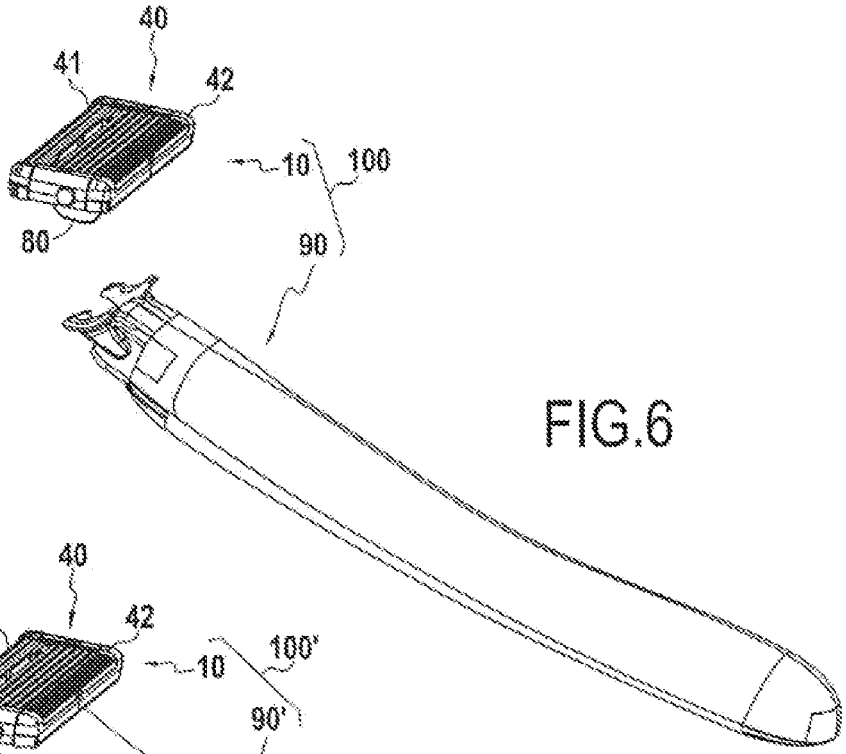
FIG. 6 is a perspective view of a razor with an interchangeable cartridge comprising a shaving blade assembly
Figure 7:
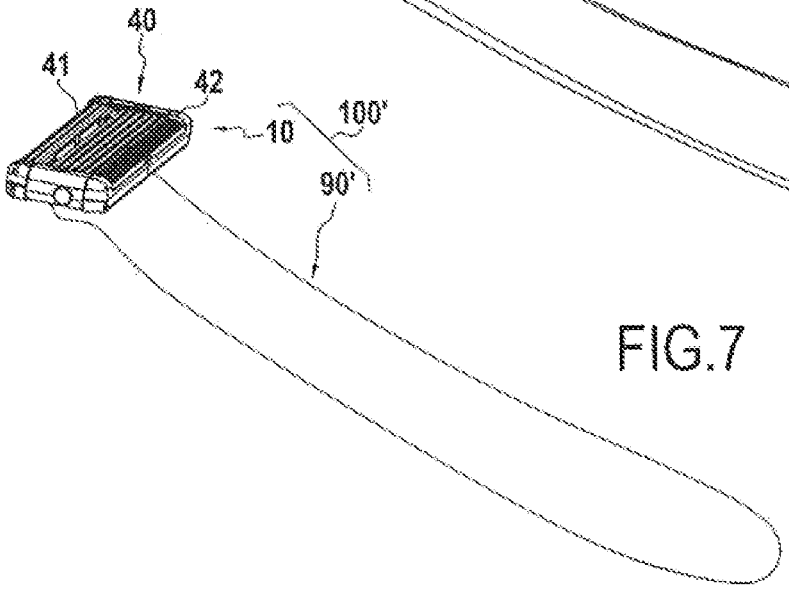

As illustrated on FIG. 6, the shaving blade assembly 10 may be formed as an exchangeable blade cartridge further comprising a releasable connector 80 for releasably connecting the shaving blade assembly 10 to a razor handle 90 to form a razor 100. Alternatively, however, as illustrated on FIG. 7, the shaving blade assembly 10 may be integrated in a disposable razor 100' with an integrally formed razor handle 90'. In either case, to provide better contact between the blades 20 and the skin, the razor 100 or disposable razor 100' may be articulated, around at least one axis, between the housing 40 and the razor handle 90, 90'.

Figure 8:
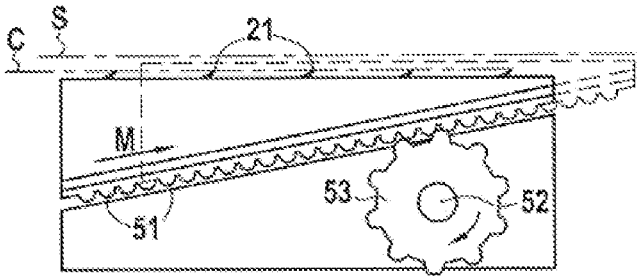
FIG. 7 is a perspective view of a disposable razor comprising a shaving blade assembly integrally formed with a handle and FIG. 8 illustrates the movement of a blade retainer in the shaving blade assembly of FIG. 1.

In operation of any one of the illustrated examples, blade exposure can be adjusted through the at least one rack-and-pinion mechanism 50 actuating a movement of the blade carrier 30, with the blades 20, in the first direction M, relative to the housing 40, which will thus move the plane C defined by the cutting edges 21 of the blades 20. As shown in FIG. 8, with respect to the embodiment illustrated on FIG. 1, starting from an initial position, a rotation of the dial wheel 54 may drive the pinion 52 through the rotary shaft 53, and this rotation of the pinion 52, engaging the rack 51, may in turn drive the blade retainer 30, with the blades 20, in the first direction M. This movement, which may go through one or several intermediate positions until a final position, may move the plane C defined by the cutting edges 21 of the blades 20 with respect to the shaving plane S to obtain a more or less bold shave. If the shaving blade assembly 10 comprises a detent mechanism 70 as shown in any one of FIGS. 3 to 5, the initial position, final position and any intermediary position may correspond to the engagement of the protrusion 71 with a corresponding recess 72, so that the blade retainer 30, with the blades 20, may be releasably held at each one of these positions, and also so that the user may be able to accurately feel the travel of the blade carrier 30 within the housing 40 through the clicking of the protrusion into and out of successive recesses 72 at intermediary positions. Alternatively, a brake mechanism that may simply be provided by the friction between moving parts in the shaving blade assembly 10 may also frictionally hold the blade retainer 30 at the initial and/or final position.

Those skilled in the art will recognize that the present invention may be manifested in a variety of forms other than the specific embodiments described and contemplated herein. Accordingly, departure in form and detail may be made without departing from the scope of the present invention as described in the appended claims.

The invention claimed is:

1. A shaving blade assembly comprising:

a plurality of parallel blades including a first blade;

a blade carrier including a first surface and a second surface, wherein each of the plurality of parallel blades extends from the first surface, and wherein the second surface is opposite of the first surface;

a housing including a guiding surface, the guiding surface engaging the second surface to define an engagement; and a first rack-and-pinion mechanism with a rack coupled to the second surface to actuate the first blade in a first direction orthogonal to a cutting edge of the first blade, wherein the engagement between the guiding surface and the second surface guides the blade carrier in the first direction.

2. The shaving blade assembly of claim 1, wherein the first blade is resiliently coupled to the rack via the carrier.

3. The shaving blade assembly of claim 1, further comprising a detent mechanism for releasably holding the first blade in at least one position along the first direction.

4. The shaving blade assembly of claim 3, wherein the detent mechanism is arranged between the housing and the rack of the first rack-and-pinion mechanism.

5. The shaving blade assembly of claim 3, wherein the detent mechanism is arranged between the housing and a pinion of the first rack-and-pinion mechanism.

6. The shaving blade assembly of claim 5, wherein the pinion is coupled in rotation with a rotary shaft and the detent mechanism is arranged between the housing and the rotary shaft, wherein the detent mechanism includes a protrusion formed on the guiding surface and a plurality of recesses formed along a surface of the rack of the first rack-and-pinion mechanism.

7. The shaving blade assembly of claim 3, wherein the rack of the first rack-and-pinion mechanism is coupled to the blade carrier to actuate the blade carrier in the first direction, wherein the first direction of the blade carrier is inclined with respect to a plane defined by cutting edges of the plurality of blades.

8. The shaving blade assembly of claim 1, wherein the second surface longitudinally extends between a first end and a second end the rack of the first rack-and-pinion mechanism is coupled to the first end of the second surface, and the shaving blade assembly further comprising a second rack-and-pinion mechanism with a rack coupled to the second end of the second surface.

9. The shaving blade assembly of claim 8, wherein a pinion of the first rack-and-pinion mechanism and a pinion of the second rack-and-pinion mechanism are coupled in rotation by a rotary shaft.

10. The shaving blade assembly of claim 9, wherein the first direction is inclined with respect to a plane defined by cutting edges of the plurality of blades.

11. The shaving blade assembly of claim 1, further comprising a releasable connector for connecting the shaving blade assembly to a razor handle.

12. A razor comprising the shaving blade assembly according to claim 11 and a razor handle connected to the releasable connector of the shaving blade assembly.

13. A disposable razor comprising the shaving blade assembly according to claim 1 and an integrally formed razor handle.

14. The shaving blade assembly of claim 1, wherein the second surface of the blade carrier and the guiding surface of the housing are transverse relative to the first surface.

15. The shaving blade assembly of claim 14, wherein the guiding surface engages a rear surface of the rack, and a friction coefficient between the guiding surface and the rear surface of the rack frictionally resists movement of the blade carrier in the first direction.

16. A method for adjusting position of a first blade of the shaving blade assembly according to claim 1 in a first direction orthogonal to a cutting edge of the first blade, comprising a step of actuating the first blade in the first direction through a rack-and-pinion mechanism with a rack coupled to the first blade.

17. A shaving blade assembly comprising:

a first blade;

a blade carrier including a first surface and a second surface, wherein the first blade extends from the first surface, and wherein the second surface Is an opposing surface of the first surface and is inclined relative to the first surface;

a first rack-and-pinion mechanism with a rack coupled to a first end of the second surface to actuate the first blade in a first direction orthogonal to a cutting edge of the first blade such that the first rack-and-pinion mechanism is configured to adjust a first blade exposure in the first direction;

a dial wheel configured to operate the first rack-and-pinion mechanism; and a housing including a guiding surface, a first blade retainer and a second blade retainer, the guiding surface engaging the second surface to define an engagement, the engagement between the guiding surface and the second surface guides the blade carrier in the first direction, wherein the first blade retainer is at a first longitudinal end of the housing and the second blade retainer is at a second longitudinal end of housing, and each of the first blade retainer and second blade retainer is configured to contact the first blade to retain it within the housing, wherein the first blade retainer or the second blade retainer includes an opening through which the dial wheel is coupled to the first rack-and-pinion mechanism.

18. The shaving blade assembly of claim 17, further comprising a second rack-and-pinion mechanism including a rack coupled to a second end of the second surface.

19. The shaving blade assembly of claim 18, wherein a pinion of the first rack-and-pinion mechanism and a pinion of the second rack-and-pinion mechanism are coupled together in rotation by a rotary shaft, and the dial wheel is configured to operate the first rack-and-pinion mechanism and the second rack-and-pinion mechanism simultaneously.

20. The shaving blade assembly of claim 19, wherein the rotary shaft longitudinally extends through the housing, and the shaving blade assembly further comprises a detent mechanism for releasably holding the first blade in at least one position along the first direction, wherein the detent mechanism includes:

a protrusion formed on an inner surface of the dial wheel, and a plurality of recesses formed on a surface of the housing that is opposite to the inner surface of the dial wheel.

* * * * *